United States Patent [19]

Kohayakawa

[11] 4,424,851

[45] Jan. 10, 1984

[54] SCREEN-OPERATING DEVICE FOR USE IN A ROLLER BLIND

[75] Inventor: Hiroyuki Kohayakawa, Tokyo, Japan

[73] Assignee: TOSO Kabushiki Kaisha, Tokyo, Japan

[21] Appl. No.: 327,462

[22] Filed: Dec. 4, 1981

[30] Foreign Application Priority Data

Jan. 8, 1981 [JP] Japan ..... 56-532[U]

[51] Int. Cl.[3] ..... E06B 9/208

[52] U.S. Cl. ..... 160/298; 160/320

[58] Field of Search ..... 160/320, 321, 322, 298, 160/307, 308

[56] References Cited

U.S. PATENT DOCUMENTS 1,841,384 1/1932 Schmelz ..... 160/298
3,854,517 12/1974 Nakamura ..... 160/321

FOREIGN PATENT DOCUMENTS 1288291 1/1969 Fed. Rep. of Germany ..... 160/321
2906279 7/1980 Fed. Rep. of Germany ..... 160/321
431900 9/1967 Switzerland ..... 160/231

*Primary Examiner*—Peter M. Caun
*Assistant Examiner*—Cherney S. Lieberman
*Attorney, Agent, or Firm*—Birch, Stewart, Kolasch & Birch

[57] ABSTRACT

A screen-operating device for use in a roller blind having a braking mechanism consisting a brake-drum secured to a bracket, a coil spring fitted on the brake-drum, a disk loosely mounted on the coil spring and integrally coupled with a screen-roll on which a screen is wound, and a cord-pulley mounted on the disk. The coil spring has their both ends inserted in an opening in the disk and the cord-pulley has its inner tung inserted between the both ends in the opening. Torque from the cord-pulley side acts on either of the both ends to loosen the coil spring and then rotates the screen-roll to raise and lower the screen. But, any torque from the screen side acts on the end to fasten the coil spring on the brake-drum and is immediately braked.

5 Claims, 5 Drawing Figures

SCREEN-OPERATING DEVICE FOR USE IN A ROLLER BLIND

BACKGROUND OF THE INVENTION

Field of the Invention

The invention relates to a screen-operating device for use in a roller blind being of a type in which an endless cord hangs down from a cord-pulley integrally coupled with a screen-roll on which a screen is wound. The screen is rolled up and down according to the direction in which the cord is pulled.

DESCRIPTION OF BACKGROUND INFORMATION

A device is known that comprises a frictional brake directly contacted with the screen-roll to prevent it from being rotated and drawing the screen by the weight of the free end of the screen, to which a weight bar is attached to stretch out the screen. However, it is very difficult to adjust the frictional brake in the optimum state. If it is tightly adjusted, the cord will become very hard to operate. To the contrary, if it is loosely adjusted, the screen will insufficiently be braked and may suddenly fall down to damage persons and articles under the blind. Even when it is adjusted in the optimum condition, it is not light to take up the screen, because the cord must be dragged by a force to overcome the sum of the weight of the screen, inclusive of the weight bar, and the frictional resistance due to the frictional brake. Another disadvantage is that the frictional brake is of no use for a wide and dense screen that is too heavy to be braked by the frictional resistance due to the frictional brake. For use with the other known device without a frictional brake, the cord is needed to be of an expensive non-slip type and inconveniently anchored through the intermediary of fittings while it is not operated.

SUMMARY OF THE INVENTION

The invention as claimed is intended to provide a remedy. It solves the problem of how to design a screen operating device for use in a roller blind of the type having a cord to be pulled for screen raising and lowering operation. The device of the invention comprises a braking mechanism consisting of a brake-drum secured to a bracket, a coil spring mounted on the brake-drum, a disk loosely mounted on the coil spring, a pivot-shaft integrally coupled with the disk and a screen-roll on which a screen is wound, and a cord-pulley mounted on the disk and belted by an endless cord. The coil spring has the opposite ends thereof inserted in an opening in the disk and individually separated by an inner tung of the cord-pulley which is also inserted in the opening. Therefore, any rotation from the pulley side causes the coil spring to loosen and the screen-roll to rotate but the rotation from the screen side causes the coil spring to be biased to the brake-drum and is immediately braked.

The advantages offered by the Invention are mainly that the screen is lightly raised. The device is axially thin and diametrically compact. The device is easily removed from and reset in the bracket set up in the permanent position. All the parts of the device are common to the right-hand and left-hand roller blinds. The cord hangs down vertically from the cord-pulley whether the bracket is fixed to the ceiling or vertical wall.

BRIEF DESCRIPTION OF THE DRAWINGS

One way of carrying out the invention is described in detail below with reference to drawings which illustrate only one specific embodiment, in which.

DETAILED DESCRIPTION OF THE INVENTION

Figure 1:
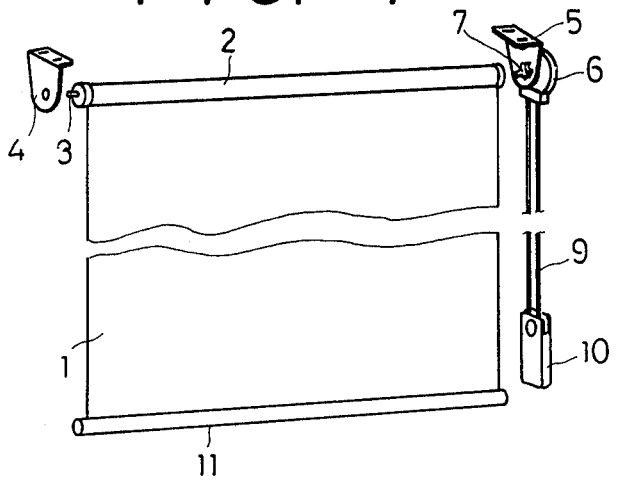
FIG. 1 is a perspective view of a roller blind equipped with an embodiment of the inventive device, illustrating the screen-roll somewhat separated from a pair of brackets.
Figure 2:
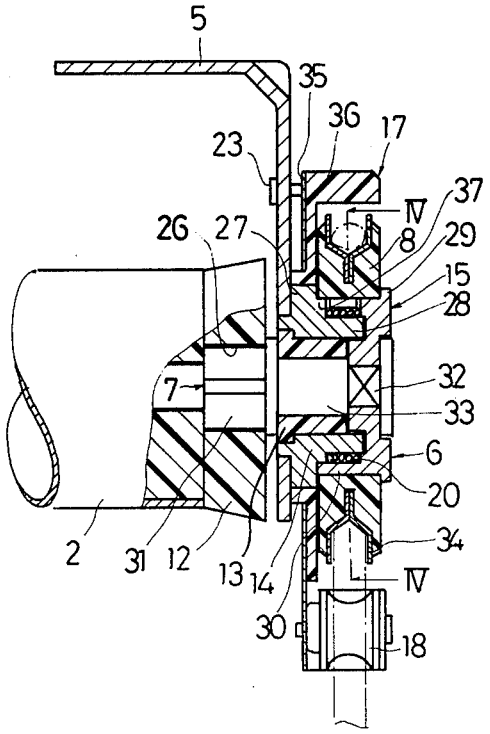
FIGS. 2 and 3 are sectional and side-elevational views of the device of FIG. 1.
Figure 4:
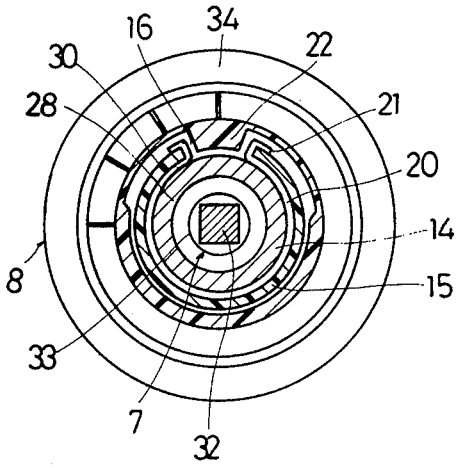
FIG. 4 is a sectional view taken on line IV—IV in FIG. 2.
Figure 3:
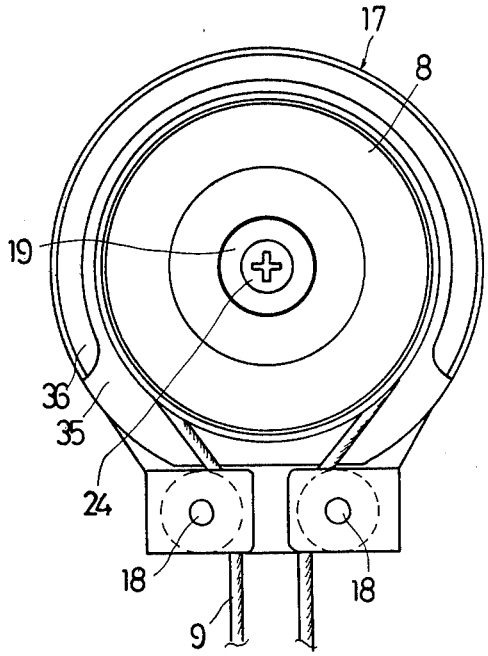
Figure 5:
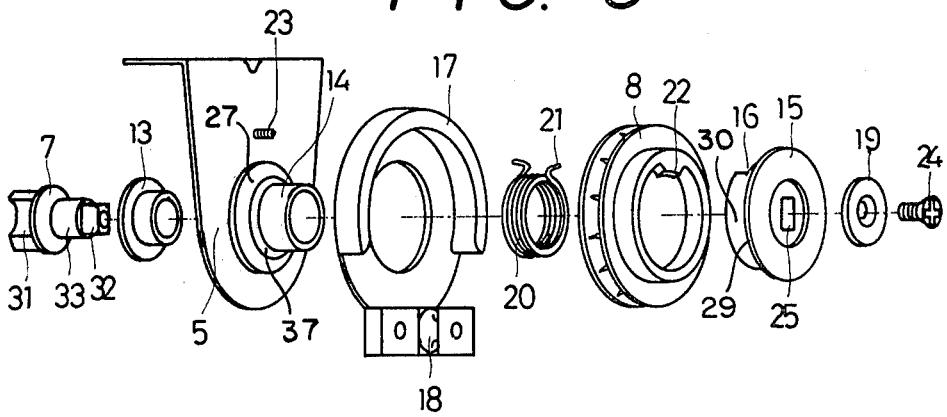
FIG. 5 is a perspective exploded view of the same device.

Referring to FIG. 1, there is a roller blind of the type having a cord to be manually operated for raising and lowering a screen 1, which is wound on a screen-roll 2 and stretched out by a weight bar 11 at the free end of the screen. The screen-roll 2 has at one end thereof a fixed pivot 3 for fitting engagement with a bracket 4. A screen-operating device 6 is mounted on the other bracket 5 and provided with a pivot-shaft 7 for fitting engagement with the other end of the screen-roll 2. An endless cord 9 vertically hangs down from the device 6 and is stretched out by a cord-weight 10.

Referring to FIGS. 2 through 5, the screen-roll 2 has an end-piece 12 formed with an angular bore 26, the pivot shaft 7 consists of inner and outer angular parts 31, 32 and middle cylindrical part 33, the middle part 33 being diametrically larger than the outer angular part 32 but smaller than the inner angular part 31. The inner angular part 31 is fitted in the angular bore 26 in the end-piece 12 and the middle part 33 is fitted in a bearing bush 13, which is fitted in a brakedrum 14. The outer angular part 32 is fitted in an angular bore 25 in a disk 15 for integral rotation of the disk 15 with the screen-roll 2. The disk 15 is fixed to the part 32 with the intervention of a washer 19 and a set-screw 24. The brakedrum 14 is fixed to the bracket 5 and formed with a flange part 27 and a brake part 28, on which a coil spring 20 is fitted. The disk 15 has a flange part 29 and a sleeve part 30 loosely mounted on the coil spring 20. The flange part 27 is formed with a shoulder part 37, the diameter of which is identical with that of the sleeve part 30 of the disk 15. A cord-pulley 8 is rotatably mounted on both the sleeve part 30 of the disk 15 and the shoulder part 37 of the brake-drum 14 and stably retained between both flange parts 27, 29. The cord-pulley 8 has a cross-sectionally V-shaped, metal-plated groove 34, in which the cord 9 is deeply wedged.

A pulley-cover 17 has a metal plate part 35 and an arcuate part 36 of synthetic resin secured to the metal plate part. The arcuate part is rotatably fitted on the flange part 27 and then fixed at an angular position by a set-screw 23, which extends from the bracket 5 to fit in one of non-illustrated radial grooves in the rear side of the pulley-cover 17. A pair of guide rolls 18 are rotatably supported by the metal plate part 35 in the opposite side of the arcuate part 36 so as to gather two strings of the cord 9 in a manner that the arc of contact between the cord 9 and the cord-pulley 8 is larger than three quarters of a turn. The inner diameter of the arcuate part 36 is slightly larger than the outer diameter of the cord-pulley 8 so as to protect the cord 9 from being out of the cord-pulley 8. The pulley-cover 17 can be set by the set-screw 23 to have the guide rolls 18 vertically suspended from the screen-roll 2 even if the bracket 5 is fixed to the vertical wall in place of the ceiling, as shown by dotted lines in FIG. 3. The outer size of the device 6 is determined by the pulley-cover 17, which is axially very thin and diametrically compact in comparison with the known device.

The coil spring 20 has the opposite ends 21 thereof radially outwardly projecting into an opening 16, which is formed in the sleeve part 30 in the disk 15. The cord-pulley 8 also has the inner tung 22 thereof inserted in the opening 16 of the disk 15. The both ends 21 of the coil spring 20 are individually separated by the inner tung 22 of the cord-pulley 8 within the opening 16. The coil spring 20 is arranged to immediately tighten on the brake-drum 14 as either of the both ends 21 is pushed by the edge of the opening 16 and rotatably loosen as either of them is pushed by the inner tung 22 of the cord-pulley 8.

The device 6 is easily set up in the permanently fixed bracket 5 to which the brake-drum 14 is previously secured, in the following way: Firstly, the pivot-shaft 7 is fitted in the bearing bush 13, which is inserted in the brake drum 14. After the pulley-cover 17 and the coil spring 20 are respectively mounted on the flange part 27 and the brake part 28, the cord-pulley 8 is mounted on the shoulder part 37 to have the inner tung 22 inserted within both ends 21 of the coil spring 20. Then, the disk 15 is put in the cord-pulley 8 to contain both ends 21 and the tung 22 in the opening 16. Finally, the disk is fixed to the pivot-shaft 7 by the washer 19 and set-screw 24 and the cover 17 is set by the set-screw 23. The device is easily removed in the counter way as described above. The endless cord 9 is easily changed when the cord-pulley 8 is dismounted together with the disk 15. All the elements of the device 6, inclusive of the bracket 5, are symmetrically shaped and common to either of the right-hand and left-hand roller blinds.

In operation, while one side string of the cord 9 is pulled down to rotate the cord-pulley 8 in one direction, the tung 22 abuts one of both ends 21 to loosen the coil spring 20 and rotate the same together with the disk 15, resulting in that the screen-roll 2 rotates with the disk 15 through the intermediary of the pivot-shaft 7 to let down the screen 1. As the other side is pulled down to rotate the cord-pulley 8 in the counter direction, the tung 22 pushes the other end 21 and rotates the same together with the disk 15. Thus, the screen-roll 2 is rotated to take up the screen 1, which has been drawn down from the screen roll 2. A force to take up the screen 1 is needed only to overcome, in torque, the dead weight of the screen 1, resulting in that the cord-pulley 8 can be small in diameter as compared with the known device. The cord 9 is tightened by the cord-weight 10 and can cause the cord-pulley 8 to rotate without slipping with a large arc of contact therebetween. On the other hand, any torque from the screen side is immediately braked, because it causes the disk 15 to push either of both ends 21 and fasten the coil spring 20 on the brake-drum 14. Thus, a wide and dense screen can not be drawn off by its own weight, even if it is too heavy to be braked by the known device.

The screen-roll can not be turned in either direction by any force acting on the screen-roll from the screen side. The screen can be raised and lowered only while the cord is manually pulled and immediately stops when the cord is released. The device according to the invention has no frictional resistance to manual operation, so that it is light to raise the screen and easy to control the raising and lowering speed of the screen.

What is claimed is:

1. A screen-operating device for use in a roller blind comprising:

a screen-roll;

a screen wound on said screen-roll;

a pair of brackets disposed a predetermined distance with respect to each other to form a space therebetween;

a pivot-shaft integrallly coupled with said screen-roll and being rotatably mounted within said space formed between said brackets;

a cord-pulley rotatably mounted outside one of said brackets at a distance displaced from said screen-roll;

actuating means being interposed between said pivot-shaft and said cord-pulley for selectively transmitting rotation from said cord-pulley to said screen-roll and for selectively braking rotation of said screen-roll;

said actuating means comprising:

a brake drum being secured to one of said brackets;

a coil spring being disposed in close proximity to an outer surface of said brake drum;

a disk including a sleeve portion, said disk being loosely mounted on said coil spring and being coupled to said pivot-shaft;

an inner tung formed on said cord-pulley and said sleeve portion of said disk including an opening formed therein for loosely mating with said inner tung;

said coil spring having opposite ends thereof inserted in said opening and being individually separated by said tung in said opening;

a pulley cover being adjustably mounted relative to said bracket for selectively changing the relative position thereof when said brackets are mounted on either a vertical or horizontal wall surface.

2. A screen-operating device according to claim 1, wherein said pivot-shaft has inner and outer angular portions respectively fitted in an angular bore in an end-piece of said screen-roll and an angular bore in said disk for rotation therewith and a middle cylindrical part rotatably fitted in a bushing in said brake-drum, said brake-drum having a flange portion being provided with a shoulder portion, said cord-pulley being rotatably mounted on both said shoulder portion of said brake-drum and said sleeve portion of said disk and axially restrained between both said flange portion of said brake-drum and a flange portion formed in said disk.

3. A screen-operating device according to claim 1, wherein said pulley cover includes rollers for guiding the movement of a cord operatively mounted on said cord-pulley.

4. A screen-operating device according to claim 1, and further including a set-screw for adjusting and affixing the positioning of said pulley-cover relative to said bracket.

5. A screen-operating device according to claim 1, wherein said cord-pulley includes a groove therein for frictionally engaging a cord operatively disposed therein.

* * * * *